US006641059B2

(12) United States Patent
Waligorski

(10) Patent No.: US 6,641,059 B2
(45) Date of Patent: Nov. 4, 2003

(54) SPRINKLER HEAD COVER

(76) Inventor: Gordon J. Waligorski, 303 W. Front St., Delphi, IN (US) 46923

( * ) Notice: Subject to any disclaimer, the term of this patent is extended or adjusted under 35 U.S.C. 154(b) by 11 days.

(21) Appl. No.: 09/758,057

(22) Filed: Jan. 10, 2001

(65) Prior Publication Data

US 2002/0088624 A1 Jul. 11, 2002

(51) Int. Cl.[7] ..... B05B 1/28

(52) U.S. Cl. ..... 239/288.5; 239/288.3; 169/37; 169/42

(58) Field of Search ..... 239/288, 288.3, 239/288.5, 208, 209; 169/51, 37, 42

(56) References Cited

U.S. PATENT DOCUMENTS

| | | | | | |
|---|---|---|---|---|---|
| 399,519 | A | * | 3/1889 | Grinnell | 169/37 |
| 2,327,528 | A | * | 8/1943 | Kendall et al. | 169/37 |
| 2,389,331 | A | * | 11/1945 | Tyden | 169/37 |
| 2,890,758 | A | * | 6/1959 | Pfalzgraff et al. | 169/37 |
| 3,388,747 | A | * | 6/1968 | Hodnett | 169/42 |
| 3,393,746 | A | * | 7/1968 | Hodnett | 169/42 |
| 6,131,822 | A | * | 10/2000 | Farmer, Jr. | 150/156 |

* cited by examiner

*Primary Examiner*—Christopher Kim
(74) *Attorney, Agent, or Firm*—Mathew R. P. Perrons, Jr.

(57) ABSTRACT

A releasable protective cover assembly for a sprinkler head is activated by heat and substantially immune to damage from blows and inappropriate use due to its dome shape, which deflects attempts to damage the cover or to abuse the sprinkler head.

2 Claims, 5 Drawing Sheets

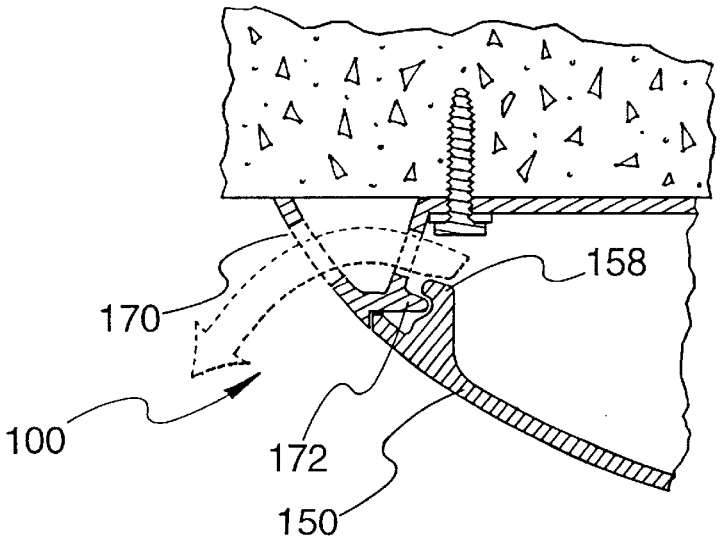
Fig.4.
Fig.5.
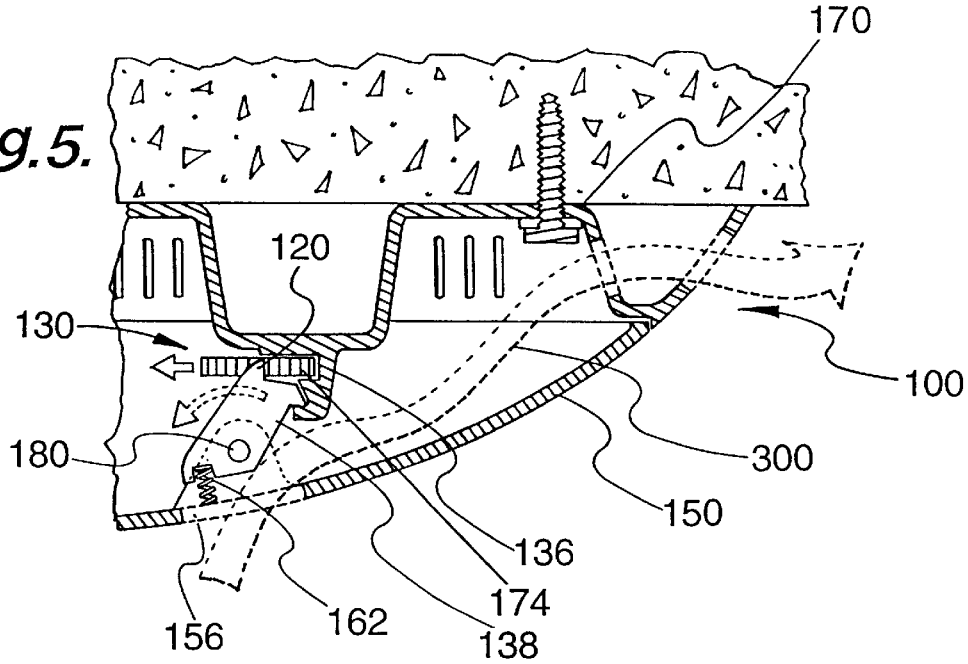

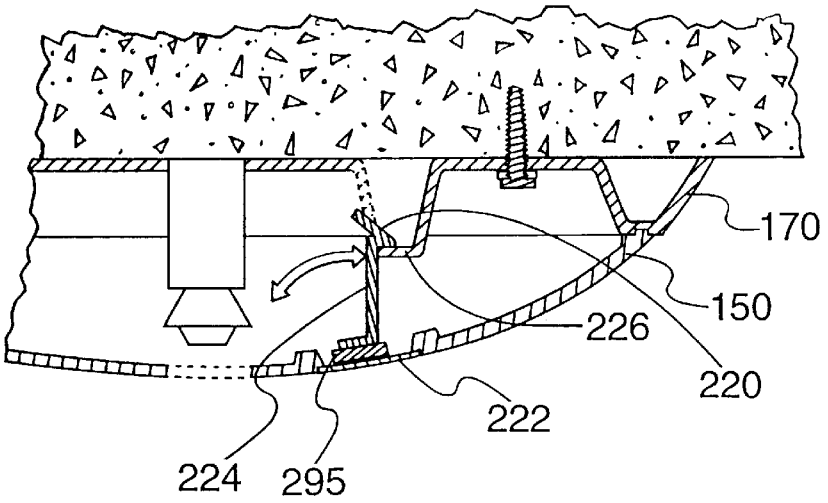
Fig. 9.
Fig. 10.
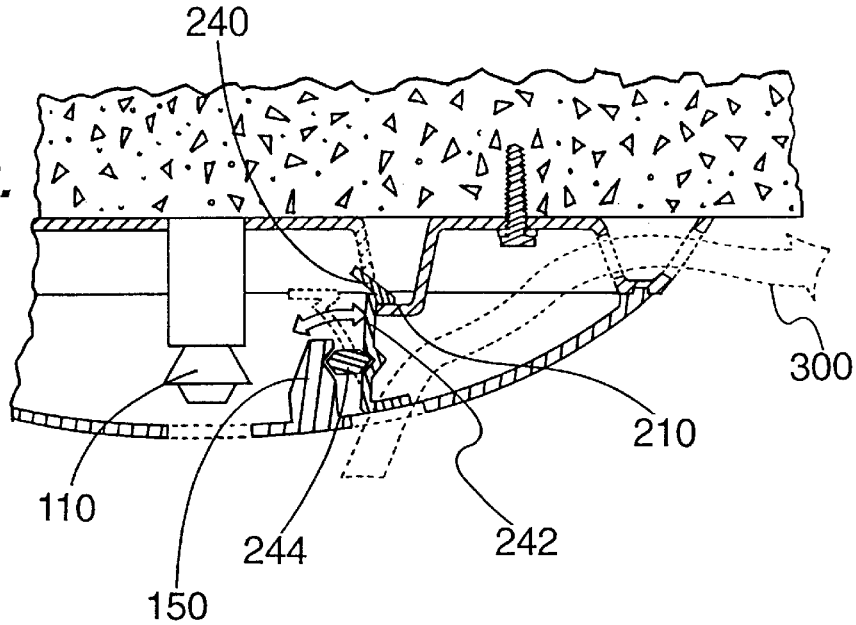

SPRINKLER HEAD COVER

This invention relates to a cover for a sprinkler head and more particularly to a protective cover for a fire suppression sprinkler head which does not interfere with the action of the sprinkler.

BACKGROUND OF THE INVENTION

Public buildings need to be safe. One requirement for public buildings, which renders them safe, is a series of sprinkler heads adapted to release water in case of a fire. With sprinkler heads dispersed throughout a building, activation and release of water on a fire can save lives and reduce property damage.

One of the problems with the structure of a sprinkler head comes from its desired configuration, in order to provide effective fire suppression. With a sprinkler head used in a prison or other incarceration facility, the typical structure of such a sprinkler head leaves it very much exposed to damage. A sprinkler head, used in an incarceration facility, may also be subjected to many inappropriate uses or treatments.

It is quite common for an incarcerated person to put a bar of soap in a sock and achieve an effective weapon for striking a blow. Such a weapon may be used against a person or a thing, such as a sprinkler head. Blows from such a weapon or any other source can damage the sprinkler head and cause an inappropriate discharge of the water, along with an undesirable disturbance.

Also, due to the structure of the sprinkler head a depressed person in such confinement may be able to fashion a sufficient noose and secure it to a sprinkler head. This structure can clearly permit a person to commit suicide or to cause a self-inflicted injury.

Thus, it is desired to protect the sprinkler head while leaving in accessible to the purpose for which it was designed, that is putting out fires. The length of the sprinkler head leaves it accessible to beating with the soap in a sock or other suitable fashion. Any known coverage or protecting device suffers from the same problem as the sprinkler head itself.

A way must be found to protect the sprinkler head, while at the same time permitting the heat to have access thereto. The heat can permit the sprinkler head to be activated. Any interference with heat reaching the sprinkler head can reduce its fire suppression capabilities to an undesired level.

Also it is desirable to protect the sprinkler head, while at the same time permitting the light to have access thereto. The light can permit the sprinkler head to be inspected. Any interference with light reaching the sprinkler head can reduce its possibility of simplified inspection of the sprinkler head and the cover assembly.

The cover of a sprinkler head, must be strongly secured against damage and prevent improper use of the sprinkler head. Such a cover must also be easily released in case of fire, so that the sprinkler may release water appropriately.

To maximize one advantage weakens the other requirement. Thus to make the protective cover strong, weakens the use of the sprinkler. To make the sprinkler head usable, the protective cover must be weakened. It is desired to maximize strength of both requirements.

SUMMARY OF THE INVENTION

Among the many objectives of this invention is the provision of a releasable protective cover for a fire protection sprinkler head.

Another objective of this invention is to provide a releasable protective cover capable of absorbing at least one blow.

Yet another objective of this invention is to provide a releasable protective cover for a fire protection sprinkler, in order to minimize an opportunity for a self inflicted injury.

Still, another objective of this invention is to provide a releasable protective cover for a fire protection sprinkler in order to minimize an opportunity for a suicide.

Additionally, an objective of this invention is to provide a releasable protective cover for a fire protection sprinkler, with minimized interference with the sprinkler head.

Also, an objective of this invention is to provide a releasable protective cover for a fire protection sprinkler, in order to minimize unrequired water release.

A further objective of this invention is to provide a releasable protective cover for a fire protection sprinkler, which provides access to heat for the sprinkler head.

A still further objective of this invention is to provide a releasable protective cover for a fire protection sprinkler, which includes a light source for inspection of the sprinkler head.

These and other objectives of the invention (which other objectives become clear by consideration of the specification, claims and drawings as a whole) are met by providing a releasable protective cover assembly for a sprinkler head, which is activated by heat and substantially immune to damage from blows and inappropriate use.

BRIEF DESCRIPTION OF THE DRAWINGS

FIG. 4 depicts a side, cross-sectioned view of a pivot support 172 for releasable protective cover assembly 100 of this invention.

FIG. 5 depicts a side, cross-sectioned view of a releasable lock 130 for releasable protective cover assembly 100 in secured position 132.

FIG. 9 depicts a side, cross-sectioned view of a fusible link trigger lock 220 for releasable protective cover assembly 100 of this invention.

FIG. 10 depicts a side, cross-sectioned view of a water-soluble trigger lock 240 for releasable protective cover assembly 100 of this invention.

Throughout the figures of the drawings, where the same part appears in more than one figure of the drawings, the same number is applied thereto.

DESCRIPTION OF THE PREFERRED EMBODIMENTS

Figure 1:
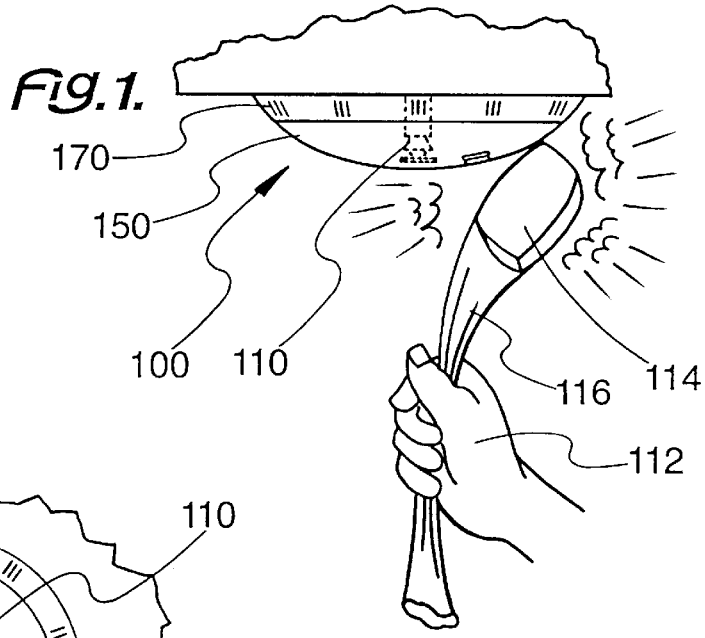
FIG. 1 depicts a perspective view of the releasable protective cover assembly 100 of this invention, with a fire protection sprinkler head 110, shown in phantom.

Over a fire suppression sprinkler head is secured a dome-shaped sprinkler head cover. This sprinkler head cover minimizes an inappropriate use of the sprinkler head. Preferably, this dome structure has a two-piece structure.

When installed, the base of the sprinkler head cover provides a lower part of a dome or truncated dome. This base preferably is applied around the sprinkler head, and secured therearound with screws or other fasteners. Preferably, at least two screws are used for fastening the base around the sprinkler head. The dome cover is secured to base, and prevents access to the mounting screws.

With the irreversible screws, the dome base can be secured around the sprinkler head and receive the dome cover. In this case, the dome cover does, but need not, protect the screws, due to the irreversible characteristic.

The dome cover or detachable canopy is secured to the dome base. Securing the dome cover to the dome base through a fixed pivot and a releasable lock both protects the sprinkler head and does not interfere with the fire suppression effectiveness of the sprinkler head. The releasable lock may include a clip and a bimetallic coil, or other suitable trigger release. The dome cover can be latched by putting on or securing to the fixed lock and latching to the releasable lock.

The trigger release may be of any suitable type as long as it is a heat-activated releasable support. A water releasable trigger may be used. A slide latch may be used. Other triggers are commonly known as a fusible link trigger or a bimetallic flat strip. A bimetallic snap base or support is available, in order to provide the heat activated release too. A spring loaded trigger is preferred.

In a preferred form, the dome base provides a male support for a fixed fastening device used in the sprinkler head cover. A sliding female support on the dome cover or detachable canopy provides support on one side of the dome cover and completes the fixed fastening device for the sprinkler head cover.

On the other side of the dome cover, a heat activated, releasable support is provided. In this fashion, the dome cover can be released from the dome base, when the cover is heated, thereby permitting the fire-suppression sprinkler head to operate. The dome base is low enough to avoid interference with the sprinkler head The male and female members of either the fixed support or the releasable support may be reversed if desired. However, the described structure of having male part on the dome base appears to simplify manufacturing.

Within the dome cover are slots, which serve a plurality of functions. Firstly, airflow or venting of the base is permitted and provides access to the sprinkler head. These slots also provide access to the catch or releasable lock through a bimetallic coil in case of heat. Also the slots in the center permit water, in addition to heat to pass therethrough at the same time, the slots are too narrow to permit wires or other implements of destruction to be passed therethrough. The hemispheric or truncated dome shape of the assembly in general, and releasable canopy in particular, deflects or absorbs blows thereto, without magnifying the blows from the soap in a sock or other implement.

The detachable canopy, when mounted on the base, is secured at one side by a sliding female support fitting on a fixed male support as a part of the base. On the other side of the detachable canopy, a trigger and latch slip combine with the female support to hold the dome thereon. A bimetallic coil or other trigger release reacts to heat and releases the cover and permits the water to flow freely in order to achieve the desired result of putting out the fire or diminishing the fire.

Other shapes are suitable for the releasable protective cover, as long as the shape deflects any blow thereto, including at least one blow. Thus, the shape may be a square with rounded corners. Other geometric shapes are feasible with the rounded corners. Such shapes are exemplified by, but not limited to, pyramid, cone, square, and stacked dome or double dome. The rounded corners deflect the blows, which may come to a device mounted in an incarceration facility. The geodesic dome may also be useful.

Referring now to FIG. 1, the releasable protective cover assembly 100 of this invention fits over a fire protection or suppression sprinkler head 110.

Over the fire suppression sprinkler head 110 is secured the releasable protective cover assembly 100. More particularly, a truncated dome ring 170 is secured around sprinkler head 110, with a single dome-shaped detachable canopy 150 releasably secured to the truncated dome ring 170. This detachable single dome canopy 150 minimizes an inappropriate use of the sprinkler head 110. Also, the single dome-shaped detachable canopy 150 minimizes or deflects the effect of a blow wielded by hand 112 with a soap bar 114 in a sock 116, or other instrument capable of dealing a blow.

Figure 2:
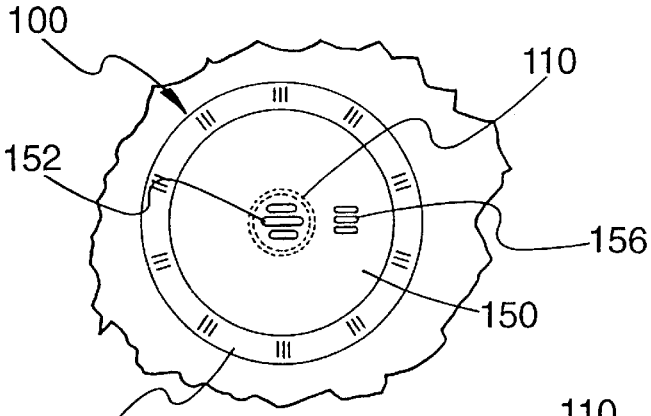
FIG. 2 depicts an upper plan view of a releasable protective cover assembly 100 of this invention for a fire protection sprinkler head 110.

Adding FIG. 2 to consideration, when installed, the base or truncated dome ring 170 provides a lower part of a dome. This truncated dome ring 170 preferably is applied around the sprinkler head 110, and secured therearound with irreversible screws 122. With the irreversible screws 122, the truncated dome ring 170 can be secured around the sprinkler head 110.

Irreversible screws 122 may or may not be protected by the releasable canopy 150. If mounting screws are covered by canopy 150, irreversible screws 122 are desired but not required.

In a preferred form included in detachable canopy 150 are centrally located sprinkler vents 152. Adjacent to an edge of detachable canopy 150 are heat sensor vents 156. While heat sensor vents 156 permit heat access to the sprinkler head 110, heat sensor vents 156 also provide for an airflow through releasable protective cover 100 and sprinkler head 110. Both sprinkler vents 152 and heat sensor vents 156 are of sufficient size to function, yet too small to permit damage to or inappropriate use of sprinkler head 110 and releasable protective cover assembly 100.

Figure 3:
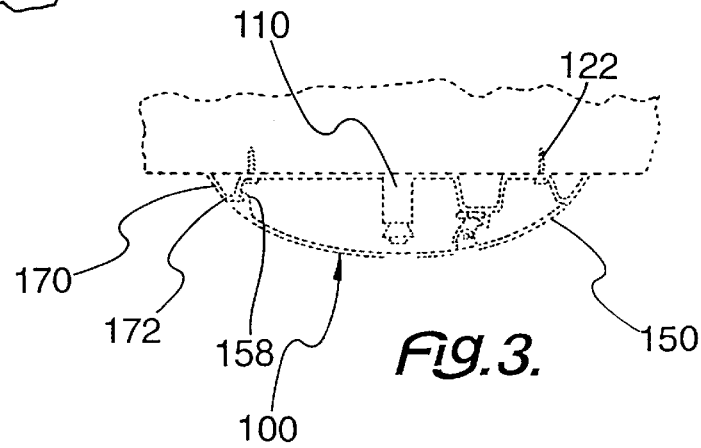
FIG. 3 depicts a side, cross-sectioned view of a releasable protective cover assembly 100 of this invention for a fire protection sprinkler head 110.

With the additional consideration of FIG. 3 and FIG. 4, the attachment of truncated dome ring 170 to detachable canopy 150 is depicted. On one side of the base or truncated dome ring 170 is male support 172. Male support 172 is received into sliding female support 158 of detachable canopy 150, in a slidable fashion. If desired, the male to female relationships may be reversed With the additional consideration of FIG. 3 and FIG. 5, the further attachment of truncated dome ring 170 to detachable canopy 150 may be seen. Oppositely disposed from male support 172, on the opposing side of the base or truncated dome ring 170, heat activated releasable coil lock 130. Releasable lock 130 includes a bimetallic coil 136 mounted on truncated dome ring 170. Movably secured to bimetallic coil 136 is securing trigger 138, shown in a closed position.

Figure 6:
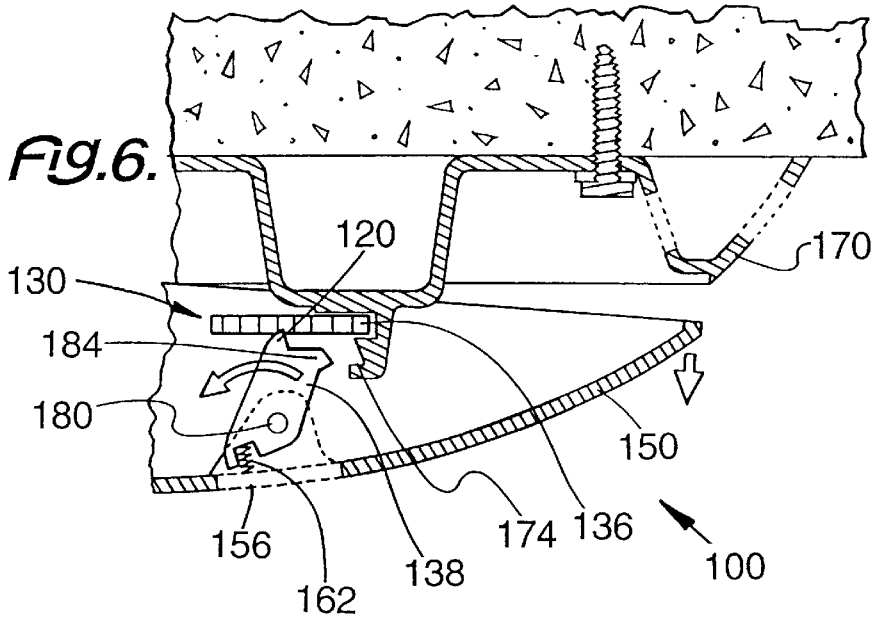
FIG. 6 depicts a side, cross-sectioned view of a releasable coil lock 130 for releasable protective cover assembly 100 in open position 134.

Adding FIG. 6 to the consideration, with latch lip 174 on truncated dome ring 170 being oppositely disposed from male support 172, the detachable canopy 150 is secured to truncated dome ring 170 by cooperation of fixed lock 120 and releasable coil lock 130. Latch lip 174 receives trigger 138 and locks detachable canopy 150 in place. Return spring 162 on detachable canopy 150 further secures trigger 138 in position on latch lip 174.

Thus, due to the double lock with fixed lock 120 and releasable coil lock 130, detachable canopy 150 is secured. Trigger pivot 180 permits trigger 138 to partially rotate when bimetallic coil 136 is heated causing an expansion thereof, followed by a release of detachable canopy 150. As bimetallic coil 136 is heated, trigger 138 is permitted to reach open position 184 and release detachable canopy 150, in order for sprinkler head 110 (FIG. 1) to be effective.

Dome cover or detachable canopy 150 may be translucent, transparent or opaque. If detachable canopy 150 is transparent, it is possible for releasable protective cover assembly 100 to be checked more easily to determine if someone has placed something through the sprinkler vents 152 and heat sensor vents 156.

Figure 7:
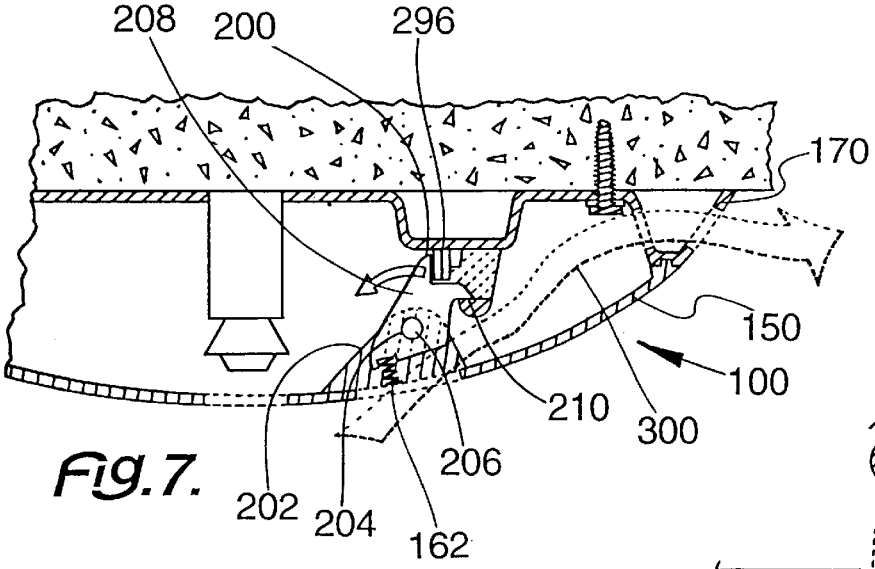
FIG. 7 depicts a side, cross-sectioned view of a releasable moving trigger lock 200 for releasable protective cover assembly 100 of this invention.
Figure 8:
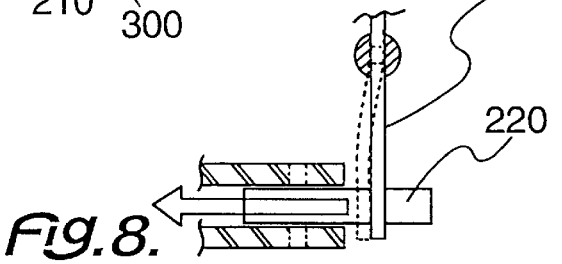
FIG. 8 depicts an end view of a releasable moving trigger lock 200 of FIG. 7 rotated ninety degrees about a vertical axis for releasable protective cover assembly 100 of this invention.

In FIG. 7 and FIG. 8 is depicted a releasable moving trigger lock 200, using a flat bimetallic strip 296 for releasable protective cover assembly 100. To activate releasable moving trigger lock 200, usually smoke flows through releasable protective cover assembly 100, as indicated by arrow 300. Releasable moving trigger lock 200 includes a dome flange 202 mounted on dome 150. In dome flange 202 is a flange aperture 204 receiving a hinge pin 206. Hinge pin 206 attaches moving trigger 208 to dome flange 202. Moving trigger 208 connects with latch step 210, and secure dome 150 on truncated dome ring 170. When the flat bimetallic strip 296 is distorted by heat from a fire or other source, trigger 208 moves away from latch step 210, thereby releasing dome 150.

Another appropriate release device for dome 150 appears in FIG. 9. Fusible link trigger lock 220 includes a metal disk 222 mounted on dome 150. Secured to metal disk 222 with fusible solder 295, which solder 295 preferably has a relatively low melting point, is trigger latch 224. Trigger latch 224 connects with angled latch step 226 on truncated dome ring 170. Upon heating of the dome 150, metal disk 222 releases trigger latch 224 and hence dome 150.

Still, another alternative for releasing dome cover 150 is shown in FIG. 10. A flat spring latch 242 is fastened to cover 150 through a water dissolvable pellet 244. Flat spring latch 242 works against the boss or pivot 240 on cover 150. When sprinkler head 110 has a water flow therethrough, that water quickly dissolves pellet 244. As a result, flat spring latch 242 returns to its preformed shape, and pulls away from latch step 210, cover 150 is released and allowed to fall. This release mechanisms herein described, amounts to a water activatable release mechanism.

Figure 11:
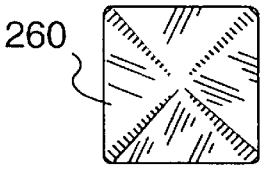
FIG. 11 depicts a top, plan view of pyramidal dome cover 260.
Figure 12:
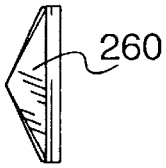
FIG. 12 depicts a side view of pyramidal dome cover 260 shown in FIG. 11.

FIG. 11 and FIG. 12 combine to depict a pyramidal dome cover 260 as an alternative to dome 150. Pyramidal dome cover 260 can also absorb blows and protect sprinkler 110. Truncated base 170 is adjusted in shape in a standard fashion to compensate therefor. Any trigger mechanism may also be used therewith.

Figure 13:
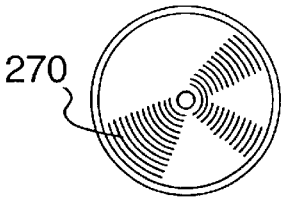
FIG. 13 depicts a top, plan view of conical dome cover 270.
Figure 14:
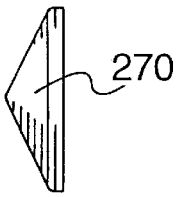
FIG. 14 depicts a side view of conical dome cover 270 shown in FIG. 13.

FIG. 13 and FIG. 14 combine to depict a conical dome cover 270 as an alternative to dome 150. Conical dome cover 270 can also absorb blows and protect sprinkler 110. Truncated base 170 is adjusted in shape in a standard fashion to compensate therefor. Any trigger mechanism may also be used therewith.

Figure 15:
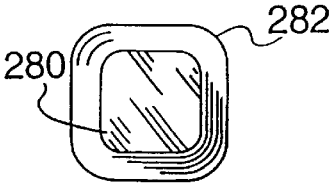
FIG. 15 depicts a top, plan view of squared dome cover 280.
Figure 16:
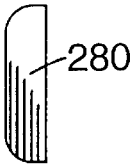
FIG. 16 depicts a side view of squared dome cover 280 shown in FIG. 15.

FIG. 15 and FIG. 16 combine to depict a squared dome cover 280 as an alternative to dome 150. Squared dome cover 280 can also absorb blows and protect sprinkler 110, especially due to its four rounded corners 282. Truncated base 170 is adjusted in shape in a standard fashion to compensate therefor. Any trigger mechanism may also be used therewith.

Figure 17:
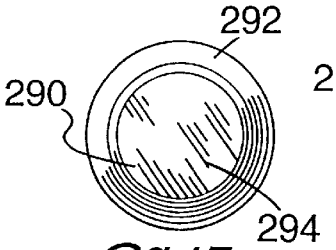
FIG. 17 depicts a top, plan view of double dome cover 290.
Figure 18:
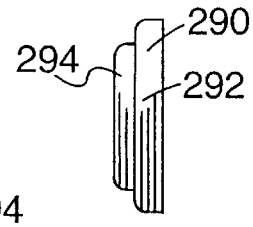
FIG. 18 depicts a side view of double dome cover 290 shown in FIG. 17.

FIG. 17 and FIG. 18 combine to depict a double dome cover 290 as an alternative to dome 150. Double dome cover 290 can also absorb blows and protect sprinkler 110. Truncated base 170 is adjusted in shape in a standard fashion to compensate therefor. Double dome cover 290 is releasably secured to truncated base 170 to give the double dome appearance and to cover sprinkler head 110.

More particularly, truncated base 170 has a larger diameter adjacent to the sprinkler head 110 than does smaller dome 294, which smaller dome with the smaller diameter covers sprinkler head 110. Any trigger mechanism may also be used with double dome cover 290.

Figure 19:
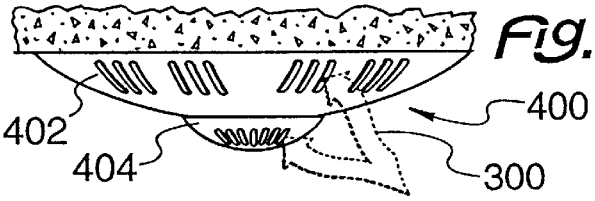
FIG. 19 depicts a side view of separable dome cover 400 as an additional modification of this invention.
Figure 20:
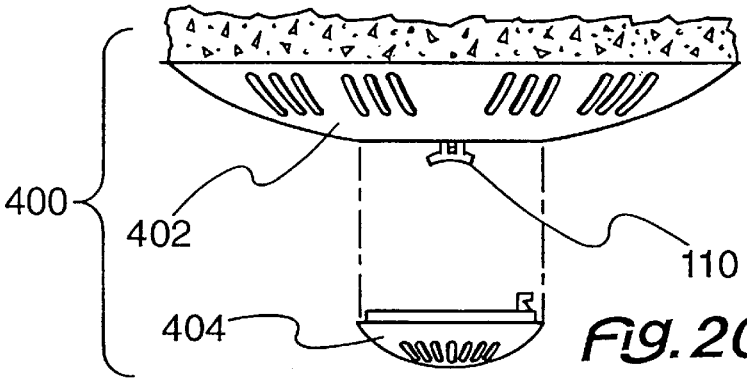
FIG. 20 depicts an exploded view of FIG. 19.

Referring now to FIG. 19 and FIG. 20, separable dome cover 400 has a slotted dome base 402 with a separable dome cover 404 releasably secured thereto. On separation, extending below dome base 402, is sprinkler head 110. Separable dome cover 404 is releasably secured to dome base 402 by any suitable trigger mechanism above described.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A sprinkler head cover having a releasable protective cover and a releasing mechanism for a fire suppression sprinkler head which avoids interference with the sprinkler head comprising:

the releasable protective cover assembly for a sprinkler head restricting access to the sprinkler head;

the releasing mechanism being adapted to release the protective cover assembly for a sprinkler head restricting access to the sprinkler head;

the releasable protective cover assembly for a sprinkler being substantially immune to damage;

the releasable protective cover assembly having a base and a dome cover releasably secured to the base;

the base being secured around the sprinkler head;

a release mechanism securing the dome cover to the base;

the release mechanism being at least selected from the group consisting of a heat activatable release mechanism and a water activatable release mechanism;

the heat activatable release mechanism being at least one selected from the group consisting of a slide latch, a fusible link trigger, a bimetallic flat strip, a bimetallic snap base and a spring loaded trigger, the water activatable release mechanism being at least one selected from the group consisting of a water releasable trigger and water releasable spring;

the base including a fixed fastening device and the release mechanism;

the fixed fastening device and the release mechanism combining to releasably secure the dome cover to the base;

the base avoiding interference with the sprinkler head;

at least one slot being in the dome cover;

the at least one slot permitting heat or water pass therethrough;

the at least one slot preventing abuse of the sprinkler head or the dome cover;

the dome cover having a shape selected from the group consisting of a square with rounded corners, a pyramid with rounded corners, a cone with rounded corners, a stacked dome, and a double dome;

the dome cover serving to deflect blows;

the release mechanism including a coil lock;

the coil lock having a latch lip and a trigger;

the latch lip being mounted on the dome base;

the trigger being mounted on the dome cover; and the latch lip receiving the trigger and locking the dome cover on a dome base.

2. A sprinkler head cover having a releasable protective cover assembly and a releasing mechanism far a fire suppression sprinkler head which avoids interference with the sprinkler head comprising:

the releasable protective cover assembly for a sprinkler head restricting access to the sprinkler head;

the releasing mechanism being adapted to release the protective cover assembly for a sprinkler head restricting access to the sprinkler head;

the base including a fixed fastening device and the release mechanism;

the fixed fastening device and the release mechanism combining to releasably secure the dome cover to the base; and a releasable protective cover assembly for a sprinkler being substantially immune to damage;

the releasable protective cover assembly having a base and a dome cover releasably secured to the base;

the base being secured around the sprinkler head;

a release mechanism securing the dome cover to the base;

the release mechanism being at least selected from the group consisting of a heat activatable release mechanism and a water activatable release mechanism;

the heat activatable release mechanism being at least one selected from the group consisting of a slide latch, a fusible link trigger, a bimetallic flat strip, a bimetallic snap base and a spring loaded trigger;

the water activatable release mechanism being at least one selected from the group consisting of a water releasable trigger and water releasable spring;

the fixed fastening device being oppositely disposed from the release mechanism;

a dome base providing a male support for the fixed fastening device used with the dome head cover;

the fixed fastening device being oppositely disposed from the release mechanism;

the dome base providing a female support for the fixed fastening device used with the dome head cover;

the base avoiding interference with the sprinkler head;

at least one slot being in the dome cover;

the at least one slot permitting heat or water pass therethrough;

the at least one slot preventing abuse at the sprinkler head or the dome cover;

the dome cover having a shape selected from the group consisting of a square with rounded corners, a pyramid with rounded corners, a cone with rounded corners, a stacked dome, and a double dome;

the dome cover serving to deflect at least one blow;

the release mechanism including a coil lock;

the coil lock having a latch lip end a trigger;

the latch lip being mounted on the dome base;

the trigger being mounted on the dome cover; and the latch lip receiving the trigger and locking the dome cover on the dome base.

* * * * *